United States Patent [19]

Lines

[11] Patent Number: 4,908,249

[45] Date of Patent: Mar. 13, 1990

[54] MARKERS FOR HYDRANTS AND OTHER UNDERGROUND UTILITIES FIXTURES

[75] Inventor: Kerry S. Lines, Winnipeg, Canada

[73] Assignee: C.K.T. Investments Limited, Winnipeg, Canada

[21] Appl. No.: 261,274

[22] Filed: Oct. 24, 1988

[30] Foreign Application Priority Data

Dec. 9, 1987 [CA] Canada ..... 553947

[51] Int. Cl.[4] ..... E01F 9/02

[52] U.S. Cl. ..... 428/36.9; 40/606; 52/103; 248/214

[58] Field of Search ..... 52/103, 104; 40/607, 40/608, 606; 425/36.9; 248/214

[56] References Cited

U.S. PATENT DOCUMENTS

| | | | |
|---|---|---|---|
| 2,167,579 | 7/1939 | Gardella | 116/173 |
| 2,202,306 | 5/1940 | Arbuckle | 52/104 |
| 3,021,601 | 2/1962 | Hayes | 248/214 |
| 3,067,717 | 12/1962 | Imparato | 116/173 |
| 3,838,661 | 10/1974 | Medley, Jr. | 40/608 |
| 4,106,879 | 8/1978 | Diedershagen et al. | 40/608 |
| 4,599,012 | 7/1986 | Kugler et al. | 40/608 |
| 4,696,134 | 9/1987 | Neaume | 52/103 |

FOREIGN PATENT DOCUMENTS

| | | |
|---|---|---|
| 109738 | 1/1908 | Canada . |
| 261690 | 6/1926 | Canada . |
| 451308 | 9/1948 | Canada . |
| 713846 | 7/1965 | Canada . |

*Primary Examiner*—James Seidleck

*Attorney, Agent, or Firm*—Murray E. Thrift; Stanley G. Ade; Adrian D. Battison

[57] ABSTRACT

A marker for fire hydrants and other underground utilities fixtures consists of an elongated tube of brightly colored resilient plastics material. It is mounted, for example, on the bottom flange of a fire hydrant by a flat metal bar bolted to the flange and carrying an upright stud that fits into the bottom end of the tube. The stud carries annular ribs with a diameter slightly greater than the inside diameter of the tube so that the tube is not readily removed from the bracket.

14 Claims, 2 Drawing Sheets

MARKERS FOR HYDRANTS AND OTHER UNDERGROUND UTILITIES FIXTURES

FIELD OF THE INVENTION

The present invention relates to markers for fire hydrants and other underground utilities fixtures, and especially to markers of this type used in winter weather to mark the location of a fire hydrant or other fixture despite the presence of a snow overburden that may cover the hydrant.

BACKGROUND

Various hydrant markers have been proposed in the past. These all suffer from various disadvantages. For example, metal hydrant markers tend to rust and therefore require frequent painting. Most markers are subject to damage from vandalism. For example, a metal bar may easily be bent out of shape, rendering the marker useless for its intended purpose.

SUMMARY OF THE INVENTION

According to the present invention there is provided a marker for an underground utilities fixture comprising an elongated tube of resilient plastics material and mounting means for mounting the tube on the fixture.

The marker preferably comprises a polyethelene tube of a bright color and a flat metal bar that bolts at one end onto the fixture, for example the bottom flange of a hydrant, and carries a stud at the other end that fits into the end of the polyethylene tube.

A marker according to the present invention is resistant to corrosion and the vandalism damage that can be caused to prior art markers. The polyethylene tube can be bent over without breaking and will return to its original upright position.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the invention, in which:

DETAILED DESCRIPTION

Figure 1:
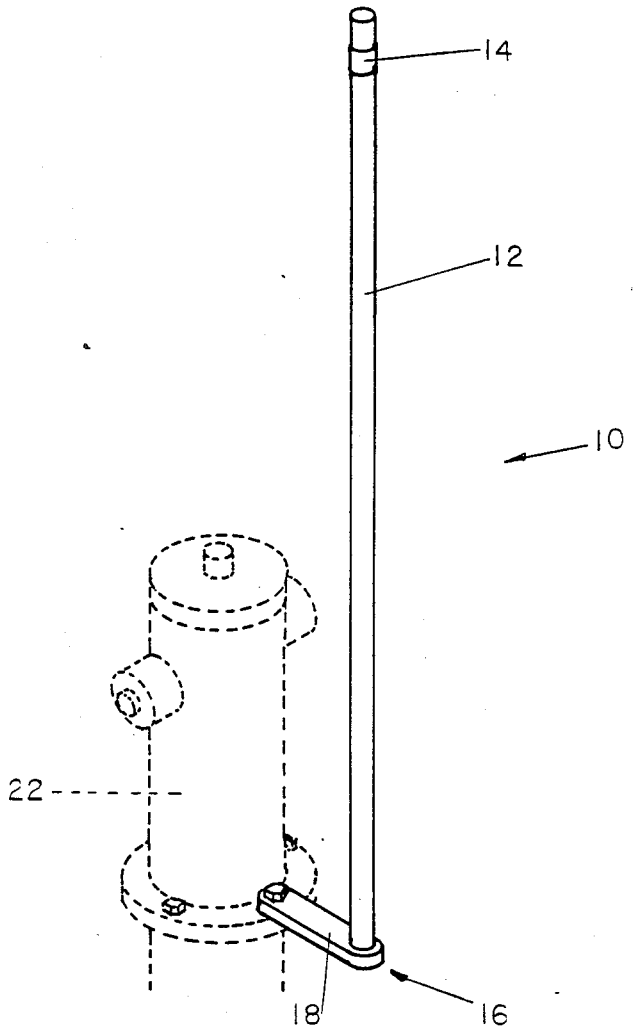
FIG. 1 is an isometric view of a marker according to the present invention.
Figure 2:
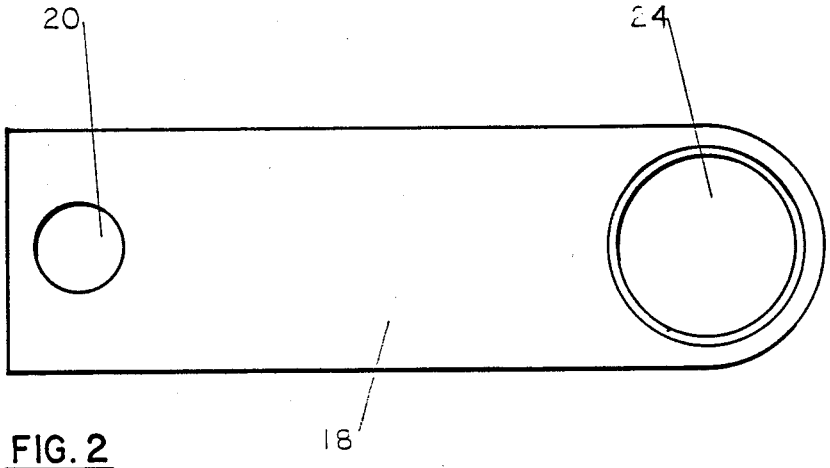
FIG. 2 is a plan view of a bracket for the hydrant marker.
Figure 3:
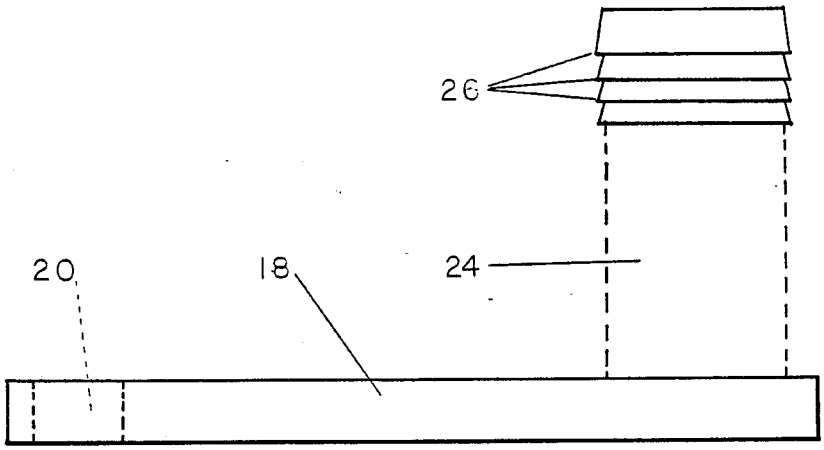
FIG. 3 is a side elevation of the bracket of FIG. 2.

Referring to the accompanying drawings and especially FIG. 1, there is illustrated a hydrant marker 10 that consists of an elongated polyethylene tube 12. The preferred tube is 1⅝ inches outside diameter, six feet long and a bright orange color. Near the top end of the tube is a reflective tape band 14 which improves the visibility of the marker under night conditions.

At the bottom end of the tube is a bracket 16 consisting of a flat metal bar 18 with a through bore 20 at one end that allows the bar to be bolted to the bottom flange of the fire hydrant illustrated in ghost line at 22 in FIG. 1. At the opposite end of the bar 18 is a metal stud 24 that projects upwardly from the bar. The stud carries a series of annular ribs 26 that have an asymmetric v-shaped profile projecting away from the end of the stud to present a barbed-like series of rings on the stud. The ribs have a maximum diameter that is slightly greater than the inside diameter of the tube.

To assemble the tube on the bracket, the bottom end of the tube is warmed to soften it and then it is forced over the stud to shrink due to subsequent cooling, thus being retained forceably on the stud against deliberate or inadvertent unauthorized removal.

While the tube has been described as being made from polyethylene, it is to be understood that other plastics materials with sufficient resiliency in the anticipated conditions of use are also useful.

A fire hydrant marker has been described in the foregoing, but it is to be understood that markers according to the invention are also useful for marking other utilities fixtures, for example manholes, water valves, underground electrical fixtures and the like.

While a single embodiment of the invention has been described above by way of example, it is to be understood that the invention is not limited to that one embodiment alone. The scope of the invention is to be ascertained solely by reference to the accompanying claims.

I claim:

1. A marker for an underground utilities fixture comprising an elongated tube of resilient plastics material and mounting means for mounting the tube on the fixture, the mounting means comprising a bracket adapted to be bolted to the fixture and a stud secured to the bracket and engaging an end of the tube.

2. A marker according to claim 1 wherein the stud has a plurality of annular ribs formed thereon.

3. A marker according to claim 2 where each rib has an asymmetric V-shaped profile projecting away from the end of the stud.

4. A marker according to claim 2 wherein the ribs have a maximum diameter slightly greater than the inside diameter of the tube.

5. A marker according to claim 1 wherein the bracket comprises a substantially flat bar with the stud projecting from one face of the bar at one end and having a bolt receiving bore adjacent the other end.

6. A marker according to claim 2 wherein the bracket comprises a substantially flat bar with the stud projecting from one face of the bar at one end and having a bolt receiving bore adjacent the other end.

7. A marker according to claim 3 wherein the bracket comprises a substantially flat bar with the stud projecting from one face of the bar at one end and having a bolt receiving bore adjacent the other end.

8. A marker according to claim 2 wherein the tube is made from a plastics material with a bright color.

9. A marker according to claim 3 wherein the tube is made from a plastics material with a bright color.

10. A marker according to claim 2 including a reflective material applied to a portion of the tube.

11. A marker according to claim 9 including a band of reflective material extending around a portion of the tube.

12. A marker according to claim 2 wherein the tube is polyethylene.

13. A marker according to claim 5 wherein the tube is polyethylene.

14. A marker according to claim 11 wherein the tube is polyethylene.

* * * * *